United States Patent [19]

Larson

[11] 4,290,543

[45] Sep. 22, 1981

[54] SUPPORT PLUG

[75] Inventor: Gordon C. Larson, Lynchburg, Va.

[73] Assignee: The Babcock & Wilcox Company, New Orleans, La.

[21] Appl. No.: 784,993

[22] Filed: Apr. 6, 1977

[51] Int. Cl.[3] ..... B23K 20/08; F28F 9/14

[52] U.S. Cl. ..... 228/2.5; 165/76; 138/89

[58] Field of Search ..... 29/421 F; 138/89, 97; 122/364; 228/2.5, 107; 220/233–237

[56] References Cited

U.S. PATENT DOCUMENTS

| | | | |
|---|---|---|---|
| 3,555,656 | 1/1971 | Brown et al. | 29/241 E |
| 3,590,877 | 7/1971 | Leopold | 138/97 X |
| 3,692,059 | 9/1972 | Ice, Jr. | 122/364 X |
| 3,708,098 | 1/1973 | Roznovsky | 138/89 X |
| 4,021,907 | 5/1977 | Zondag | 138/89 X |

*Primary Examiner*—Samuel Scott
*Assistant Examiner*—Theophil W. Streule, Jr.
*Attorney, Agent, or Firm*—Robert J. Edwards; John L. Lapierre

[57] ABSTRACT

An apparatus for supporting the tubes adjacent to a leaky tube to be sealed by explosive activated plugs, and including removable support plugs inserted into the ends of the adjacent tubes to provide the required tube wall and tube sheet support during detonation of the explosive activated plugs, with the support plugs being removed after the leaky tube is sealed.

6 Claims, 11 Drawing Figures

FIG. 8
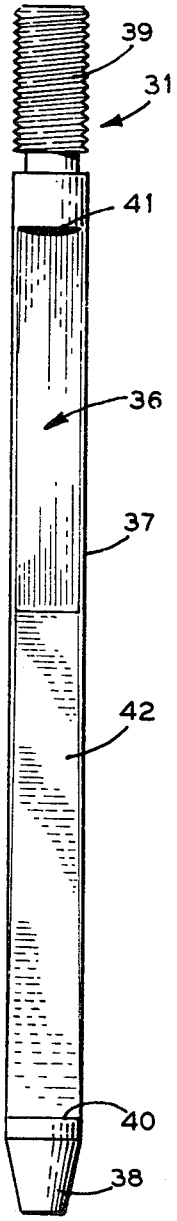
FIG. 7
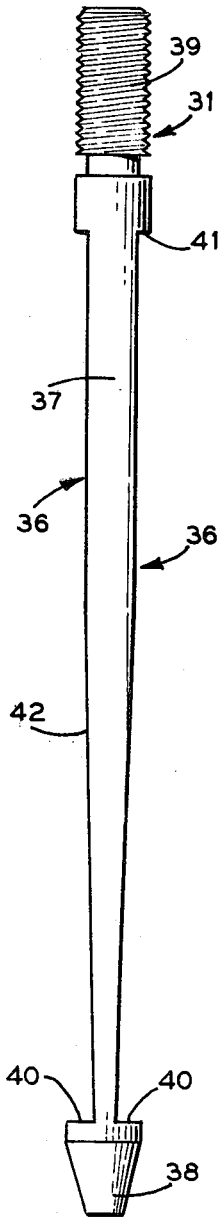
FIG. 6
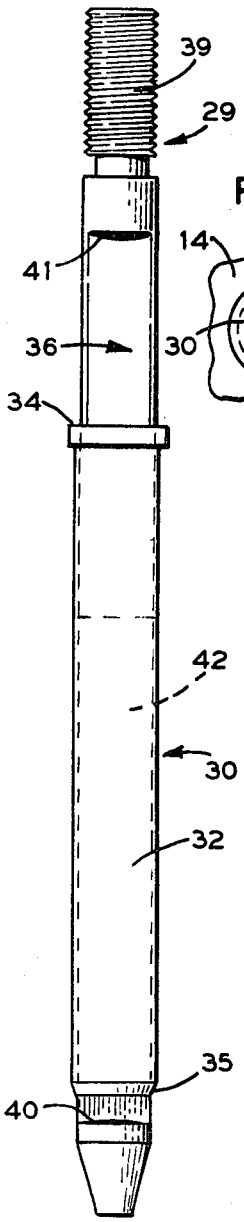
FIG. 5
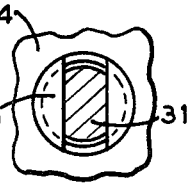
FIG. 4
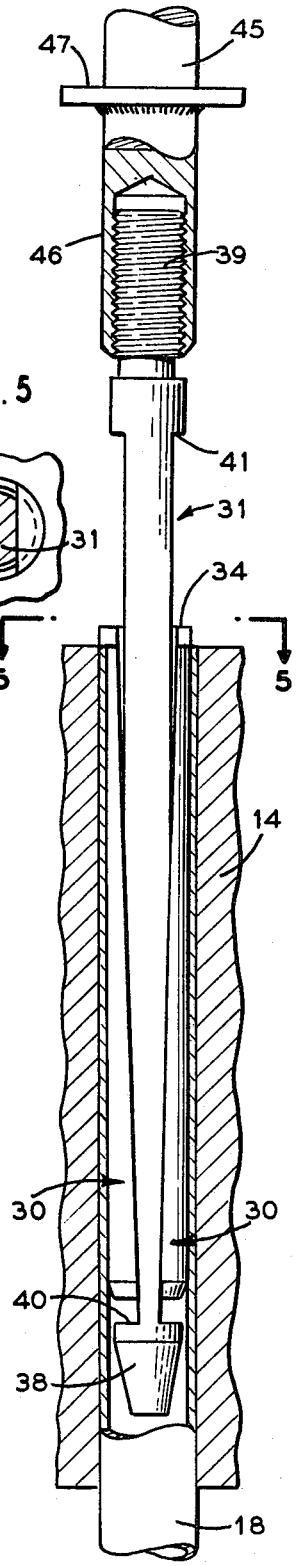
FIG. 9
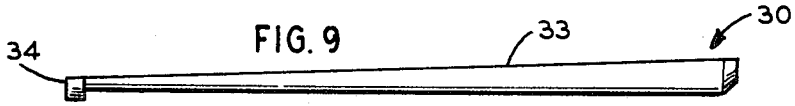
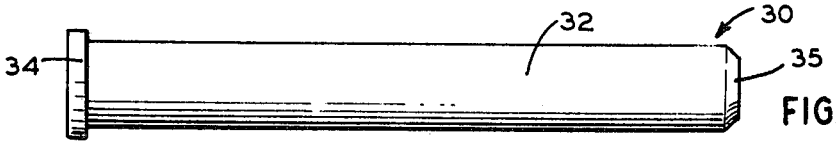
FIG. 10

SUPPORT PLUG

BACKGROUND OF THE INVENTION

The invention relates to the art of sealing a leaky tube in a sheet-and-tube type heat exchanger through the detonation of explosive activated metal plugs inserted at both ends of the tube, and more particularly to an apparatus and method wherein distortion of the adjacent tubes and tube sheet ligaments by the explosive forces is substantially minimized.

Heat exchangers of the type to which this invention is especially applicable, are constructed with a large number of relatively small diameter tubes grouped in what is commonly referred to as a bundle. Heat is exchanged between a fluid passing through the tubes and a fluid in contact with the outside of the tubes. The fluids are physically separated by tubes and tube sheets, with one tube sheet being located at each end of the tube bundle. It is becoming common practice to seal off a leaky tube in this type of heat exchanger by employing an explosive activated plug in the form of a hollow metal body that is inserted at each end of the tube to be sealed. The plug contains a shaped explosive charge and a detonator which can be set off from a remote location to detonate the charge and thereby expand the plug body against the tube surface with an impact of sufficient force to weld the plug to the surrounding tube surface and form a fluid tight seal therebetween.

Some difficulty has been encountered with explosive welding in this type of heat exchanger where the closeness of the tubes is such that tubes adjacent to the leaky tube, and the tube sheet ligament therebetween may be significantly distorted by the explosive forces released during the detonation of a sealing plug in the leaky tube.

SUMMARY OF THE INVENTION

The present invention relates to apparatus for inhibiting the distortion of tubes and tube sheets located adjacent to a tube being sealed off by explosive welding.

Accordingly, there are provided removable support plugs which are inserted in the tubes adjacent to a leaky tube to be sealed by explosive activated plugs. Each of the support plugs includes a pair of wedges and a wedge-like actuator which, when driven toward the supported tube, expands the wedges radially outward against the surrounding tube wall to provide the required tube wall and tube sheet support during detonation of the explosive activated plug. When the leaky tube is sealed, the actuator is driven away from the supported tube, releasing the wedges and allowing removal of the support plug from the supported tube.

BRIEF DESCRIPTION OF THE DRAWINGS

FIG. 4 is a detail view of a support plug inserted into the end of a tube;

FIG. 5 is a sectional plan view taken along line 5—5 in FIG. 4;

FIG. 6 is a further detail view of the support plug assembly;

FIG. 7 is a detail view of an actuator seen along one of its arcuate sides;

FIG. 8 is a detail view of an actuator seen along one of its flat sides;

FIGS. 9 and 10 are detail views of a wedge; and

DESCRIPTION OF THE PREFERRED EMBODIMENT

Figure 1:
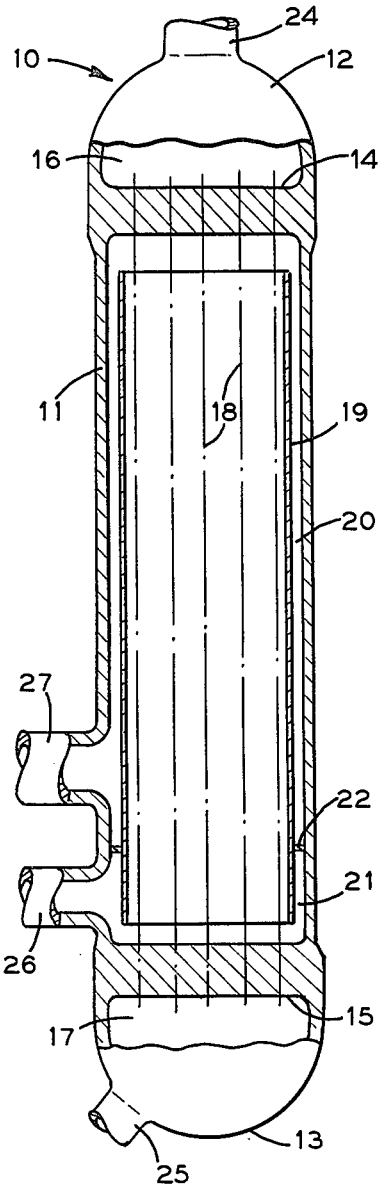
FIG. 1 is a sectional elevation view of a once-through vapor generator unit of the character which would employ this invention.

FIG. 1 illustrates a heat exchanger in the form of a once-through vapor generating unit 10 comprising a vertically elongated cylindrical pressure vessel 11 closed at its opposite ends by an upper head member 12 and a lower head member 13. The vessel 11 is transversely divided by upper and lower tube sheets 14 and 15, respectively. The upper tube sheet 14 is integrally attached to vessel 11 and upper head member 12 and forms, in combination with the upper head member 12, a fluid inlet chamber 16. The lower tube sheet 15 is integrally attached to vessel 11 and lower head member 13 and forms, in combination with the lower head member 13, a fluid outlet chamber 17.

A plurality of straight tubes 18 arranged to form a tube bundle extend vertically between the upper and lower tube sheets 14 and 15 and penetrates through both tube sheets to interconnect the fluid inlet chamber 16 with the fluid outlet chamber 17.

A cylindrically shaped shroud member 19 surrounds the bundle of tubes 18 and extends upwardly from a plane located above the lower tube sheet 15 and terminates at a plane located below the upper tube sheet 14. The shroud member 19 cooperates with the vessel 11 to form an annular shaped compartment therebetween. The compartment is divided into inlet and outlet passageways 21 and 20 by an annular plate 22 welded about its outer edge to the vessel 11 and around its inner edge to the shroud member 19.

During normal operation of the vapor generating unit 10, primary coolant received from a pressurized water reactor or a similar source, not shown, is supplied to the upper chamber 16 through an inlet nozzle 24. The primary coolant gives up heat to a secondary fluid during passage through the tubes 18 and is discharged from the lower chamber 17 through an outlet nozzle 25. A feed fluid is admitted through an inlet nozzle 26 and is constrained by plate 22 to flow downward in the passageway 21, and thence into the open lower end of shroud 19. The feed fluid is heated and vaporized by heat transfer through tubes 18 from the primary coolant. The vapor thus produced, which can be either saturated or superheated depending upon the amount of heat exchange, passes out the open upper end of shroud 19 and into passageway 20, for exit through an outlet nozzle 27.

It should be recognized that there are a large number of tubes 18 in the entire bundle within the vapor generating unit 10. Consequently, it is common practice to overcome a leak in any given tube by merely sealing off the interior of such tube by plugging the ends at the tube sheets 14 and 15. In this manner, a given tube which has developed a leak is isolated and effectively removed from the flow path for the primary coolant passing through the interior of the tubes. The remaining tubes of the bundle continue to act in the normal manner to provide heat exchange as desired. As is common practice, the leaky tube is sealed off by employing an explosive activated plug in the form of a hollow metal body that is inserted into the ends of the tube to be sealed, and which contains a shaped explosive charge and a detonator that can be set off from a remote location to detonate the charge and thereby expand the plug body against the tube surface with an impact of sufficient force that it creates a zone of metallurgically bonded metal contact between the plug and surrounding tube surface, which zone extends completely around the circumference of the plug body and along an axial length portion thereof intermediate its ends.

Since the construction and arrangement of the tubes 18 with respect to the tube sheets 14 and 15 is generally the same, it is deemed sufficient to describe the invention in conjunction with the upper tube sheet 14.

Referring now to FIGS. 2 through 10 wherein the reference numerals designate like or corresponding parts throughout, there are shown support plugs 29 inserted in the tube sheet ends of tubes 18 situated adjacent to the leaky tube 18A. Each of the support plugs 29 is comprised of a pair of wedges 30 and a wedge like actuator 31.

Each of the wedges 30 is formed with an arcuate side 32, generally matching the inner contour of tube 18, and a flat side 33. The arcuate side 32 includes a shoulder portion 34 at one end thereof and a tapered portion 35 at the other end. The wedge 30 is axially tapered along its flat side 33 in the direction of the shoulder portion 34.

The actuator 31 has a major axial portion thereof formed with a pair of opposing flat sides 36 interconnected by arcuate sides 37, and includes a frusto-conical member 38 at one end thereof and a threaded stub 39 at the other end. The large end of member 38 abuts a pair of ledges 40 extending laterally along the flat sides 36. A shoulder portion 41 is formed between the flat sides 36 and the threaded stub 39. Each of the actuator flat sides 36 has a portion 42 which is axially tapered in the direction of the frusto-conical member 38.

Figure 2:
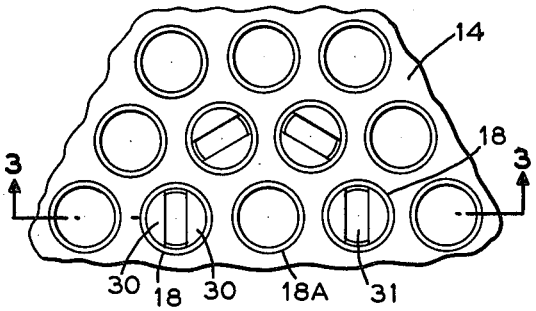
FIG. 2 is a sectional plan view taken along line 2—2 in FIG. 3.
Figure 3:
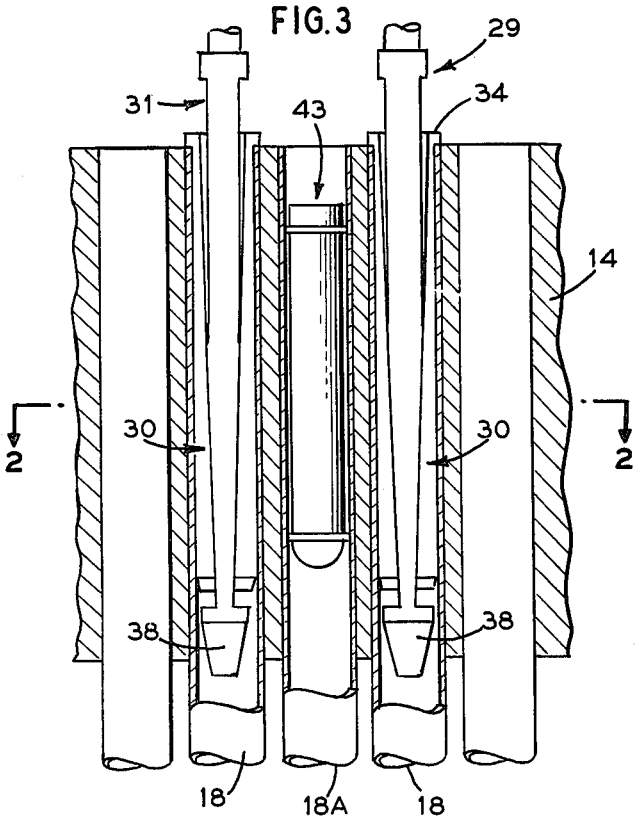
FIG. 3 is a sectional elevation view taken along line 3—3 in FIG. 2.

In order to seal the leaky tube 18A, an explosive activated plug 43 of the type disclosed in U.S. Pat. No. 3,590,877 is positioned within the tube sheet ends of tube 18A, and is shown at FIGS. 2 and 3 with respect to the upper tube sheet 14. Each of the support plugs 29 is assembled by positioning the tapered ends 35 of wedges 30 on the ledges 40 and placing the tapered sides 33 of wedges 30 against the oppositely tapered portions 42 of actuator 31. The assembled support plug 29 is then inserted into one of the tube 18 adjacent to the tube 18A. The support plug 29 is preferably positioned, as shown at FIG. 2, with one of the wedges 30 abutting tube 18 along the wall portion facing the tube 18A. The shoulder portion 34 abuts against the tube end face and prevents further axial movement thereby insuring that the wedges 30 remain positioned within the tube sheet ends of tube 18. The actuator 31 is then driven further into tube 18 thus expanding the wedges 30 radially outward against the surrounding wall of tube 18 for the support thereof and of the tube sheet 14.

After the explosive plug 43 has been detonated and the body of plug 43 has consequently been autogeneously welded to the surrounding tube wall thereby sealing the end of tube 18A, the actuator 31 is driven out thus releasing the wedges 30 and permitting the support plug 29 to be removed from the tube 18.

Figure 11:
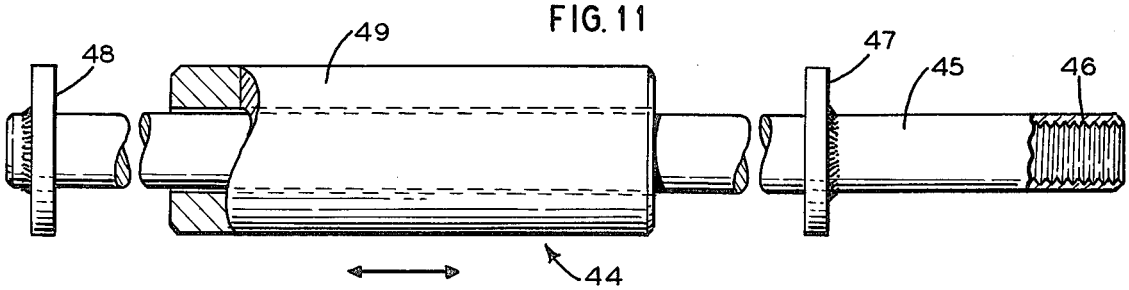
FIG. 11 is a detail view of a tool for driving the actuator toward and away from the tube.

Any tool that would include some means for threadably engaging it with the actuator stub 39, might be employed to drive the actuator 31 toward and away from the supported tube. However, a preferred tool is one such as shown at FIG. 11. The preferred tool 44 comprises a guide rod 45 having an internally threaded end 46 for engaging the actuator stub 39 at FIG. 4 and includes a pair of axially spaced disks 47 and 48 weldably mounted on the guide rod 45, and a hand-operated ramming cylinder 49 slidably mounted on the rod 45 intermediate the disks 47 and 48. The cylinder 49 is moved to strike the disk 47 when it is desired to drive the inserted actuator 31 toward the supported tube so as to expand the wedges 30 radially outward against the surrounding tube wall, thus providing the required tube wall and tube sheet support. Conversely, the cylinder 49 is moved to strike the disk 48 when it is desired to drive the actuator 31 away from the tube 18 thereby releasing the wedges 30 to allow removal of the support plug assembly from the supported tube.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are as follows:

1. In combination with a pressure vessel comprising tube sheet means transversely arranged therein, a plurality of fluid conveying tubes disposed within the vessel, the tubes having their ends connected to the tube sheet means, and including explosive activated plugs disposed for insertion into the ends of a leaky tube, means for detonating the explosive in the inserted plugs to fix the plugs to the surrounding tube walls thereby sealing the ends of the leaky tube, the improvement comprising means for supporting the tube sheet means and the ends of tubes adjacent to the leaky tube during detonation of the explosive, the supporting means including support plugs removably inserted into and bearing against the ends of said adjacent tubes.

2. The combination according to claim 1 wherein each support plug includes means for expanding it radially outward against the surrounding tube wall.

3. The combination according to claim 2 wherein the expanding means includes an elongated member having tapered sides.

4. The combination according to claim 3 wherein the support plug includes a pair of wedges, each wedge having a tapered side engaging a corresponding tapered side of said elongated member.

5. The combination according to claim 4 including each of the wedges having an arcuate side generally matching the inner contour of said supported tube.

6. The combination according to claim 4 including the elongated member having ledges formed at one end thereof for facilitating the insertion and removal of the wedges from said supported tube.

* * * * *

UNITED STATES PATENT AND TRADEMARK OFFICE

CERTIFICATE OF CORRECTION

PATENT NO. : 4,290,543

DATED : September 22, 1981

INVENTOR(S) : GORDON C. LARSON

It is certified that error appears in the above-identified patent and that said Letters Patent are hereby corrected as shown below:

Column 3, line 14, delete "the" and substitute therefor the word --like--.

Column 4, line 7, the words --as shown-- should be inserted between the numeral "39" and the word "at".

Column 4, line 30, the word --defined-- should be inserted between the word "are" and the word "as".

UNITED STATES PATENT AND TRADEMARK OFFICE

CERTIFICATE OF CORRECTION

PATENT NO. : 4,290,543

DATED : September 22, 1981

INVENTOR(S) : Gordon C. Larson

It is certified that error appears in the above-identified patent and that said Letters Patent are hereby corrected as shown below:

Add the circle, lead line, and numeral "43" to FIG. 2.

FIG. 2

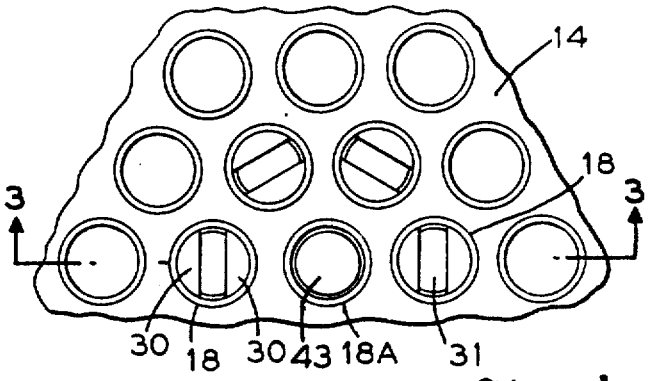

Signed and Sealed this

Fifth Day of January 1982

[SEAL]

Attest:

GERALD J. MOSSINGHOFF

Attesting Officer

Commissioner of Patents and Trademarks